US007288158B2

(12) United States Patent
Thomson et al.

(10) Patent No.: US 7,288,158 B2
(45) **Date of Patent: *Oct. 30, 2007**

(54) MANUFACTURING PROCESS FOR PRODUCING HIGH STRENGTH STEEL PRODUCT WITH IMPROVED FORMABILITY

(75) Inventors: Barton A. Thomson, Sault Ste. Marie (CA); James W. Johnston, Sault Ste. Marie (CA)

(73) Assignee: Algoma Steel Inc., Sault Ste. Marie, Ontario (CA)

( * ) Notice: Subject to any disclaimer, the term of this patent is extended or adjusted under 35 U.S.C. 154(b) by 134 days.

This patent is subject to a terminal disclaimer.

(21) Appl. No.: 11/075,938

(22) Filed: Mar. 9, 2005

(65) Prior Publication Data

US 2005/0199320 A1 Sep. 15, 2005

Related U.S. Application Data

(63) Continuation-in-part of application No. 10/798,039, filed on Mar. 11, 2004.

(30) Foreign Application Priority Data

Mar. 10, 2004 (CA) ..... 2460399
Jul. 12, 2004 (CA) ..... 2473765

(51) Int. Cl.
*C21D 8/02* (2006.01)

(52) U.S. Cl. ..... 148/541; 148/546; 148/547; 148/653; 148/654; 148/661

(58) Field of Classification Search ..... 148/541, 148/546, 547, 602, 653, 654, 661, 320, 601
See application file for complete search history.

(56) References Cited

U.S. PATENT DOCUMENTS 3,139,359 A 6/1964 Morgan
4,167,105 A 9/1979 Harris (Continued)

FOREIGN PATENT DOCUMENTS

FR 2850398 7/2004
JP 05051695 8/1991
WO WO 99/05337 2/1999

OTHER PUBLICATIONS

Carl A. Keyser, Materials Science in Engineering, "Metal Fabrication and Its Effects on Properties", p. 236, published 1974.*

(Continued)

*Primary Examiner*—Deborah Yee
(74) *Attorney, Agent, or Firm*—Ladas & Parry LLP

(57) ABSTRACT

A flat rolled, high strength, formable steel product has a yield strength of at least about 100 ksi. The product has sufficient formability such that it can withstand a longitudinal or transverse 180° bend of less than 1.0 times its thickness and is preferably comprised of a high strength, low alloy steel composition containing a vanadium-nitride microalloy. The steel product is preferably produced by cold rolling a first steel product having a yield strength of at least about 70 ksi and a n-value from about 0.1 to about 0.16. Cold rolling of the first steel product reduces its thickness and increases its yield strength to at least 100 ksi.

34 Claims, 5 Drawing Sheets

U.S. PATENT DOCUMENTS

| | | | | |
|---|---|---|---|---|
| 4,415,376 | A | | 11/1983 | Bramfitt et al. |
| 5,906,691 | A | | 5/1999 | Burnett et al. |
| 6,030,470 | A | * | 2/2000 | Hensger et al. ..... 148/541 |
| 6,149,740 | A | | 11/2000 | Bald et al. |
| 6,280,542 | B1 | | 8/2001 | Cornelissen et al. |
| 6,669,789 | B1 | | 12/2003 | Edelman et al. |

OTHER PUBLICATIONS

Crowther et al., "The Evolution of Microstructure during Thin Slab Direct Rolling Processing in Vanadium Microalloyed Steels", ISIJ International, vol. 42 (2002), No. 6, pp. 636-644.

Glodowski, "Vanadium Microalloying in Steel Sheet, Strip and Plate Products", Use of Vanadium in Steel, A Selection of Papers Presented at the Vanitec International Symposium, Beijing, China, Oct. 13-14, 2001, published by Vanitec, Vanadium International Technical Committee, Westerham, Kent, England, 2002.

Zajac, "Ferrite Grain Refinement and Precipitation Strengthening in V-Microalloyed Steels", 43rd MWSP Conf. Proc., ISS, vol. XXXIX, 2001, pp. 497-508.

Flemming et al., "Extension of Product Range and Perspectives of CSP Technology", MPT Metallurgical Plant and Technology International, vol. 23, Issue No. 1, Feb. 2000.

Glodowski, "Experience in Producing V-Microalloyed High Strength Steels by Thin Slab Casting Technology", Presented at the International Symposium on Thin Slab Casting and Rolling, Guangzhou, China, Dec. 2002, pp. 1-11.

* cited by examiner

MANUFACTURING PROCESS FOR PRODUCING HIGH STRENGTH STEEL PRODUCT WITH IMPROVED FORMABILITY

This application is a Continuation-in-part of case Ser. No. 10/798,039 filed Mar. 11, 2004.

FIELD OF THE INVENTION

The present invention relates to high strength steel products, and more particularly to high strength low alloy (HSLA) flat rolled steel products having high yield strength and high formability. The invention also relates to manufacturing processes for producing flat rolled steel products having high yield strength and high formability.

BACKGROUND OF THE INVENTION

Most HSLA steels are produced in conventional processes where molten steel from a basic oxygen furnace (BOF) or an electric arc furnace (EAF) is cast, cooled, reheated and reduced in thickness while still hot in a rolling mill. The rolling mill reduces the thickness of the slab to produce thin gauge steel sheet or strip material having high strength characteristics. Some HSLA steels are produced by modern thin-slab or medium-slab casting processes in which slabs of steel, still hot from the caster, are transferred directly to a reheating or equalizing furnace prior to thickness reduction in the hot rolling mill.

HSLA steel products are commonly used for automotive and other applications where high strength and reduced weight are required. Such applications also require material having good formability to allow it to be shaped into parts.

Due to the steel microstructure and metallurgical transformations taking place in the material during hot rolling, reducing the gauge of the material also causes the material to become harder. As the hardness increases, further thickness reduction by rolling becomes more difficult, and the rolling mill must operate with increasing power levels to reduce the material thickness to the desired level at a particular width. Due to the high power required to reduce the thickness, higher strength HSLA sheet or strip material, typically having a strength above about 350 MPa, is only available in limited widths.

As the strength of the material is increased through rolling, the subsequent formability of the material in service is reduced. This makes shaping of the material more difficult. Thus, rolling the HSLA material to light gauges interferes with the ability to shape the material, limiting its utility for many applications requiring high strength, light weight and good formability, such as automotive applications.

Therefore, there is a need for HSLA steel products having high strength, thin gauge and acceptable formability.

SUMMARY OF THE INVENTION

In one aspect, the present invention provides a process for producing a steel product comprised of high strength, low alloy steel containing a hardness-promoting microalloy and having a yield strength of at least about 100 ksi, the process comprising: (a) casting molten steel to form a solid, as-cast product having a thickness, the as-cast product comprising austenite; (b) transferring the as-cast product to a first rolling apparatus, wherein a temperature of the as-cast product as it enters the first rolling temperature is greater than a recrystallization stop temperature of the austenite; (c) conducting a first reduction step in the first rolling apparatus to reduce the thickness of the as-cast product by a first amount, thereby producing a first thickness-reduced product, wherein a temperature of the as-cast product entering the first rolling apparatus and a temperature of the first thickness-reduced product exiting the first rolling apparatus are above the recrystallization stop temperature; (d) holding the first thickness-reduced product at a temperature above the recrystallization stop temperature for a time sufficient to permit substantially complete recrystallization of the austenite and thereby reduce a grain size of the austenite; (e) transferring the first thickness-reduced product to a second rolling apparatus; (f) conducting a second reduction step in the second rolling apparatus to reduce the thickness of the first thickness-reduced product by a second amount, thereby producing a second thickness-reduced product, wherein a temperature of the first thickness-reduced product entering the second rolling apparatus and a temperature of the second thickness-reduced product exiting the second rolling apparatus are above a phase transformation temperature at which austenite is transformed to ferrite; (g) cooling the second thickness-reduced product to below the phase transformation temperature, thereby producing a cooled product; and (h) conducting a third reduction step in a third rolling apparatus to reduce the thickness of the cooled product by a third amount, thereby producing the steel product having a yield strength of at least about 100 ksi.

In another aspect, the present invention provides a process for producing a high strength, formable steel product having a yield strength of at least 100 ksi, comprising: (a) providing a first steel product comprised of high strength, low alloy steel containing a hardness-promoting microalloy, the first steel product having a yield strength of at least about 70 ksi and less than 100 ksi, the first steel product having a formability, as measured by n-value, within a range from about 0.1 to about 0.16; and (b) cold rolling the first steel product to reduce its thickness and increase the yield strength to at least 100 ksi, while maintaining sufficient formability such that the high strength, formable steel product can withstand a longitudinal or transverse 180° bend of less than 1.0 times its thickness.

In yet another aspect, the present invention provides steel products comprised of high strength, low alloy steel containing a hardness-promoting microalloy and having yield strength of at least about 100 ksi, produced according to the processes of the invention.

In yet another aspect, the present invention provides a flat rolled, high strength, formable steel product having a yield strength of at least about 100 ksi and having sufficient formability such that it can withstand a longitudinal or transverse 180° bend of less than 1.0 times its thickness, the steel product being comprised of a high strength, low alloy steel containing a vanadium-nitride alloy.

BRIEF DESCRIPTION OF THE DRAWINGS

The invention will now be described, by way of example only, with reference to the accompanying drawings, in which.

DETAILED DESCRIPTION OF PREFERRED EMBODIMENTS

The process according to the present invention preferably utilizes many of the same process steps and apparatus as modern thin slab and medium slab processes for producing flat rolled steel products. Typical processes of this type utilize a furnace to produce molten steel, at least a portion of which may comprise scrap material. The molten steel is cast, preferably on a continuous basis, to produce a slab having a thickness of from about 30 to about 200 mm. According to the present invention, it is preferred that the hot as-cast slab is directly charged into a reheating or equalizing furnace to prevent excessive cooling. However, the process of the invention is also compatible with processes in which the as-cast slab is allowed to cool before further processing.

Figure 1A:
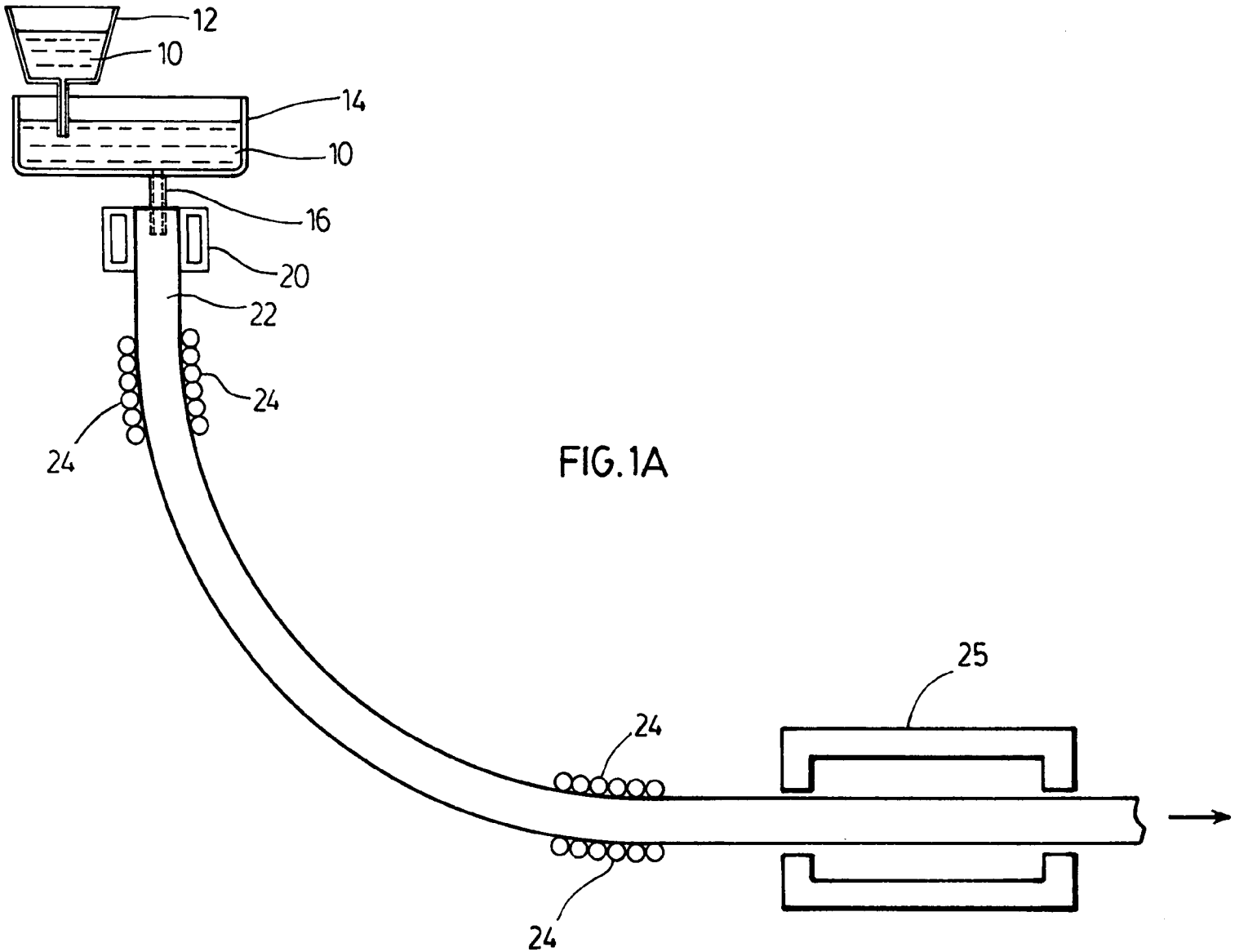
FIG. 1 is a schematic diagram illustrating the process and apparatus according to the invention.
Figure 1B:
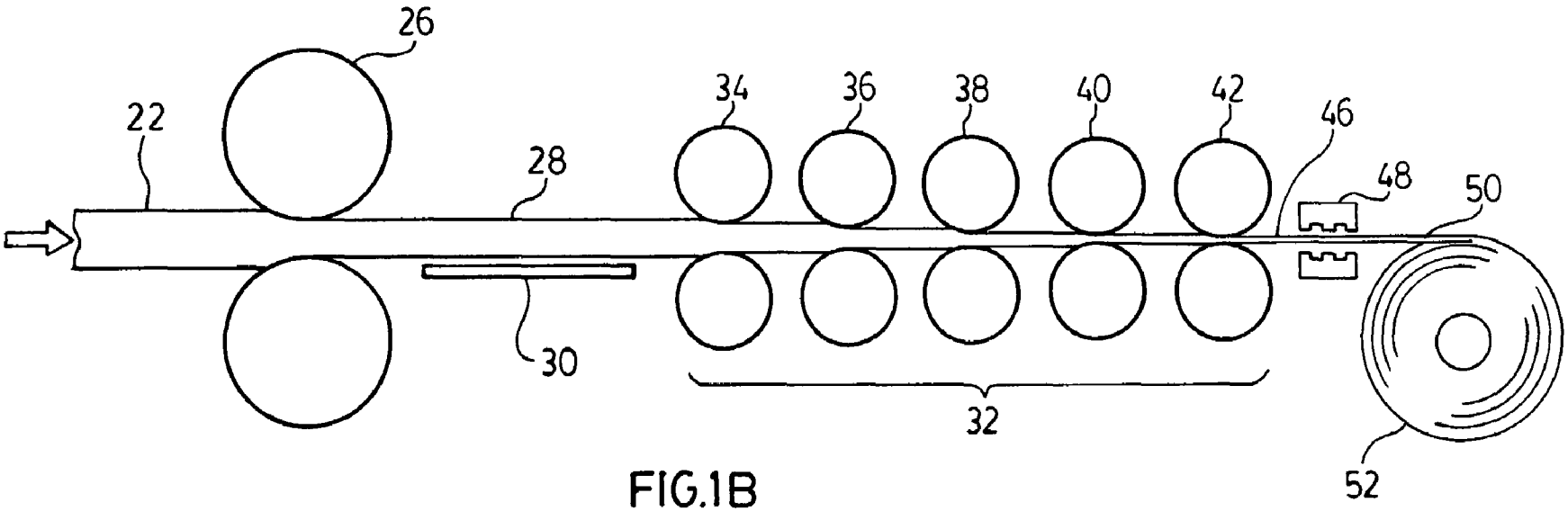
Figure 1C:
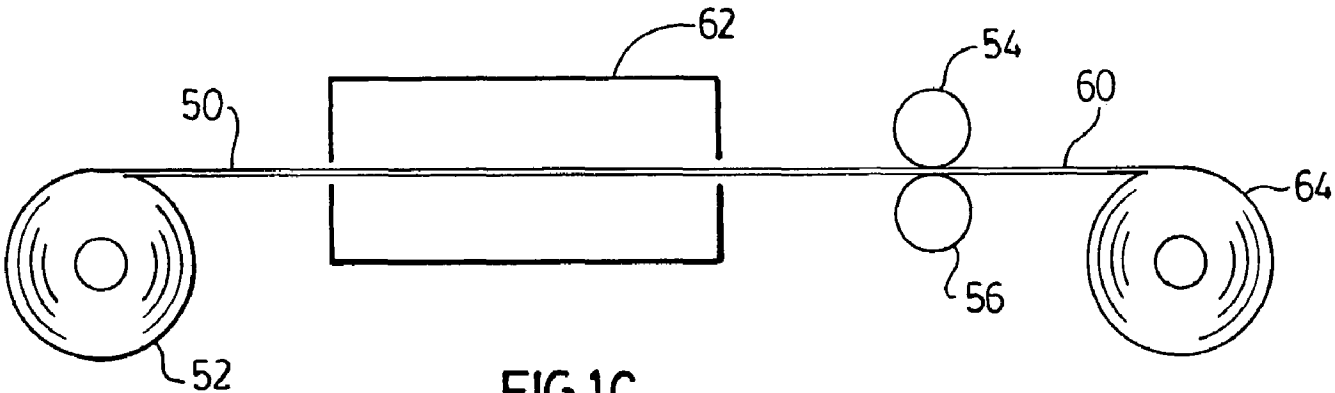

A preferred process and apparatus according to the present invention are schematically illustrated in FIG. 1. As in known thin slab and medium slab casting processes, molten steel 10 is produced in a furnace (not shown) which may preferably comprise a BOF or an EAF. The molten steel 10 is withdrawn from the furnace and is transferred to a ladle 12, also known as a ladle metallurgy station (LMS), where alloy elements may be added to the molten steel 10. The molten steel 10 is transferred from the ladle 12 to a tundish 14. The tundish 14 has a nozzle 16 through which the molten steel 10 flows into a water-cooled mold 20 which preferably comprises a continuous casting mold. The steel solidifies in the mold 20 to form an as-cast steel product 22 which, as shown in FIG. 1, preferably comprises a continuous sheet or strip of steel which is shaped and guided along a path by rollers 24.

In most known thin slab and medium slab casting processes, the thickness of the as-cast product is from about 30 to about 200 mm, typically in the range of from about 30 to 80 mm, and more typically from 50 to 75 mm. Even more typically, the thickness of the as-cast product is no greater than 50 mm so that the as-cast material can be directly accepted by a hot rolling strip mill. In the process of the present invention, the thickness of the as-cast product is preferably in the range from about 70 mm to about 80 mm, more preferably about 70 mm to about 75 mm, and even more preferably about 72 mm.

In terms of composition, the steel preferably comprises a high strength low alloy (HSLA) steel composition which includes a hardness-promoting microalloy. Preferably, the microalloy is a vanadium-nitride (V-N) alloy having a composition which is the same as or similar to the V-N alloy steel compositions set out in Table 1 of Glodowski, "Vanadium Microalloying in Steel Sheet, Strip and Plate Products", pages 145 to 157, Use of Vanadium in Steel, A Selection of Papers Presented at the Vanitec International Symposium, Beijing, China, 13-14 Oct. 2001, published by Vanitec, Vanadium International Technical Committee, Westerham, Kent, England, 2002, preferably those having a yield strength of about 550 MPa or greater. The Glodowski paper is incorporated herein by reference in its entirety.

Most preferably, the nitrogen is present in a sub-stoichiometric amount relative to the vanadium (i.e. mole ratio of V:N>1:1; weight percent ratio V:N>3.6:1). In addition to vanadium and nitrogen, the steel composition may also contain one or more other elements selected from the group comprising carbon, manganese, silicon, molybdenum, niobium, and aluminum. In a particularly preferred embodiment of the invention, the steel composition according to the invention comprises up to about 0.080 wt % carbon, from about 1.00 to about 1.65 wt % manganese, from about 0.01 to about 0.40 wt % silicon, from about 0.07 to about 0.13 wt % vanadium, from about 0.015 to about 0.025 wt % nitrogen and about 0.008 wt % molybdenum or niobium. In an example of a composition having an acceptable V:N ratio, the nitrogen content is about 0.020 wt % and the vanadium content is about 0.10 to about 0.12 wt %.

In terms of microstructure, the as-cast steel product 22 is comprised of a mixed austenite structure comprised of grains having a wide range of grain sizes, ranging roughly from about 100 μm to about 1,000 μm. The austenite grains in the surface regions of the as-cast product 22 tend to be larger columnar grains while those in the interior of the as-cast product tend to be smaller particles with a more spherical shape. The grains of the as-cast product are subjected to refinement as described below in order to provide a fine grain structure throughout the product and to attenuate variations in grain size and structure, thereby contributing to the high strength and formability of the final product.

As mentioned above, in conventional processes the as-cast slab is cast, cooled and reheated prior to entering the strip mill. In order to minimize use of energy to reheat the slab, the as-cast steel product in the process of the invention is preferably not permitted to cool to ambient temperature after emerging from the continuous casting mould 20. Preferably, the as-cast product is directly charged into an equalization or reheating furnace 25 which causes retention of the coarse as-cast microstructure. The temperature of the as-cast steel product 22 as it enters the furnace 25 is greater than the recrystallization stop temperature, preferably greater than about 1020° C., more preferably in the range from about 1020 to about 1200° C., and even more preferably from about 1050 to about 1200° C.

The temperature inside the equalizing furnace 25 is sufficient to maintain the temperature of the as-cast product above the recrystallization stop temperature, preferably above about 1020° C., more preferably in the range from about 1020 to about 1200° C., and even more preferably from about 1050 to about 1200° C. This temperature is sufficiently high to prevent significant precipitation of V-N particles in the steel, and to permit recrystallization of austenite, which occurs in subsequent process steps. It will, however, be appreciated that the process according to the invention includes embodiments in which the as-cast slab is cast, cooled and reheated as in conventional processes.

In most known thin-slab and medium-slab casting processes, the as-cast product is transferred from the equalization furnace directly to a hot rolling strip mill in which the product is reduced to its final thickness dimension. In a typical process, the strip mill may reduce the thickness of the steel product from about 50 mm to below 1.5 mm. The strip mill typically comprises about five or six rolling stands which are closely coupled together, with a typical interpass time of from about 0.3 to 6 seconds.

In contrast, according to the present invention, the as-cast product 22 is transferred directly from the equalization furnace 25 to a rougher 26, also referred to herein as a roughing mill. In the rougher 26, the thickness of the as-cast product 22 is reduced, preferably in one pass, by an amount of from about 40 to about 60% of the thickness of the as-cast product, thereby producing a rough-reduced product 28. For example, where the thickness of the as-cast product is 75 mm, the rougher reduces the thickness of the product to the range of about 30 to 45 mm. The rougher 26 is preferably in close proximity to the equalization furnace 25, so that the as-cast product 22 is not significantly cooled prior to entering the rougher 26. Accordingly, the temperature of the as-cast steel product 22 as it enters the rougher 26 (the "rougher entry temperature") is above the recrystallization stop temperature, preferably above about 1020° C., more preferably in the range of about 1020 to about 1200° C., and even more preferably about 1050 to about 1200° C.

During the roughing operation, the columnar and mixed grains in the as-cast austenite structure are flattened and elongated. Deformation of the austenite grains under selected temperature conditions and for selected periods of time, as in the present invention, causes recrystallization of the austenite and results in reduction of austenite grain size as well as attenuation of variations in the grain size and shape.

Thus, the rougher entry temperature and the temperature of the rough-reduced steel product 28 as it exits the rougher 26 (the "rougher exit temperature") must be sufficiently high to permit recrystallization of the austenite to occur. Most preferably, the rougher entry temperature and the rougher exit temperature are greater than the recrystallization stop temperature so as to promote recrystallization of the austenite. Also, the rougher entry temperature and the rougher exit temperature are sufficiently high to prevent significant precipitation of the microalloy during the roughing stage. Preferably, the rougher entry and exit temperatures are above the recrystallization stop temperature, preferably above about 1020° C. and more preferably in the range from about 1020 to about 1200° C. Even more preferably, the rougher entry temperature is from about 1050 to about 1200° C. and the rougher exit temperature is from about 1020 to about 1150° C.

In addition to proper temperature control during the roughing stage, the inventors have found that it is important to carefully control the temperature of the rough-reduced product 28 after it exits the rougher 26. Specifically, the rough-reduced material 28 is preferably held at a temperature high enough and for a time sufficient to permit substantially complete recrystallization of the austenite grains, preferably such that at least about 90 percent of the austenite grains are within about 100 to about 400 μm in size. The recrystallized austenite grains tend to be round and have an attenuated variation in structure as compared to the as-cast product.

Preferably, the rough-reduced product 28 is held at a temperature greater than the recrystallization stop temperature of the austenite, preferably above about 1020° C., more preferably in the range from about 1020 to about 1200° C., and even more preferably from about 1020° C. to about 1150° C. Preferably, the rough-reduced product 28 is held at this temperature for a time of from about 10 to about 30 seconds, more preferably from about 15 to about 25 seconds. During this time, the relatively coarse austenite grains of mixed shape and size, which have been flattened and elongated in the rougher 26, recrystallize to the smaller, more regular grain size and shape mentioned above.

In order to ensure that the temperature of the rough-reduced product 28 is maintained at a suitable level during recrystallization, the rough-reduced product 28 preferably exits the rougher 28 and is transferred directly to a heating apparatus such as a second furnace (not shown) or a heated run-out table 30 having a temperature sufficient to maintain the temperature of the rough-reduced product 28 above the recrystallization stop temperature, preferably above about 1020° C., more preferably in the range from about 1020 to about 1200° C., and even more preferably from about 1020 to about 1150° C.

After the recrystalization step, the rough-reduced product 28 is transferred to a second rolling apparatus, preferably a hot rolling strip mill 32, for further thickness reduction. Preferably, the strip mill 32 is in close proximity to the heated run-out table 30 so that the temperature of the rough-reduced product 28 entering the strip mill 32 is substantially the same as the temperature at which the austenite was recrystallized, i.e. above the recrystallization stop temperature, preferably above about 1020° C., more preferably in the range from about 1020 to about 1200° C., and even more preferably from about 1020 to about 1150° C. In other words, the temperature of the rough-reduced product 28 entering strip mill 32 is preferably greater than the recrystallization stop temperature and is greater than a temperature at which significant precipitation of microalloy will occur in the strip mill 32. Furthermore, the temperature of the rough-reduced material 28 is sufficiently high so that the temperature of the hot rolled product 48 exiting the rolling mill is greater than a temperature at which austenite is transformed to ferrite and is greater than a temperature at which significant precipitation of the microalloy will occur. Preferably, the temperature of the hot rolled product 46 exiting the rolling mill is greater than about 820° C., more preferably in the range from about 820° C., to about 950° C. Therefore, the rough-reduced product 28 remains in the austenitic state during the entire rolling operation and the microalloy essentially remains in solution during the entire rolling operation. Furthermore, the rough-reduced product 28 entering the strip mill 32 is at a temperature sufficient for further recrystallization to occur as it passes Through the strip mill, resulting in further grain refinement.

The strip mill 32 itself is of conventional form, comprising a plurality of rolling stands in which the thickness of the rough-reduced product is progressively reduced to produce the hot rolled product 46 having a thickness of from about 1 mm to about 6 mm, usually from about 1 mm to about 2 mm. Preferably, the strip mill 32 comprises from four to six stands, and the preferred strip mill schematically shown in the drawings comprises a total of five stands 34, 36, 38, 40 and 42. The time interval between adjacent rolling stands, also referred to as the "interpass time" is preferably from about 0.3 to about 6 seconds. It will be appreciated that the thickness reduction achieved in the strip mill (measured as a fraction of the thickness of the hot rolled product 46) may preferably be greater than the thickness reduction achieved in the rougher (measured as a fraction of the thickness of the as-cast product 22). However, the thickness reduction (measured in mm) is typically, but not necessarily, greater in the rougher than in the strip mill.

After hot rolling, the product 46 is quickly cooled, preferably at a rate up to about 70° C. by water as shown at 48, to a temperature at which austenite is transformed to ferrite, and at which the microalloying elements precipitate. After cooling to an appropriate temperature, preferably less than about 820° C., more preferably in the range from ambient temperature to about 700° C., even more preferably in the range from about 550° C. to about 700° C., the flat rolled product 50 is preferably wound into a coil 52 and allowed to cool to ambient temperature before further processing. The cooled (ambient temperature) product is referred to herein as the flat rolled steel product 50.

In most known thin-slab and medium-slab casting processes, the steel entering the strip mill retains the columnar and mixed grain structure of the as-cast slab. Much of the recrystallization of the austenite in the prior art processes occurs between the first and second rolling stands in the strip mill. However, due to the relatively short interpass times in the strip mill, this amount of time is insufficient to permit complete recrystallization of the austenite. Thus, the austenitic grain structure of the product remains in a relatively variable state and does not achieve the same level of refinement produced in the process of the present invention. As the product is rolled it becomes stronger, making further thickness reduction difficult. On known thin-slab and medium-slab processes which do not utilize a rougher, the entire thickness reduction from the as-cast product to the final product must be accomplished in the strip mill. As the gauge is reduced, the power required to achieve the final dimensions increases and as the mill works harder, it becomes more difficult to keep tolerances within acceptable limits.

Figure 2:
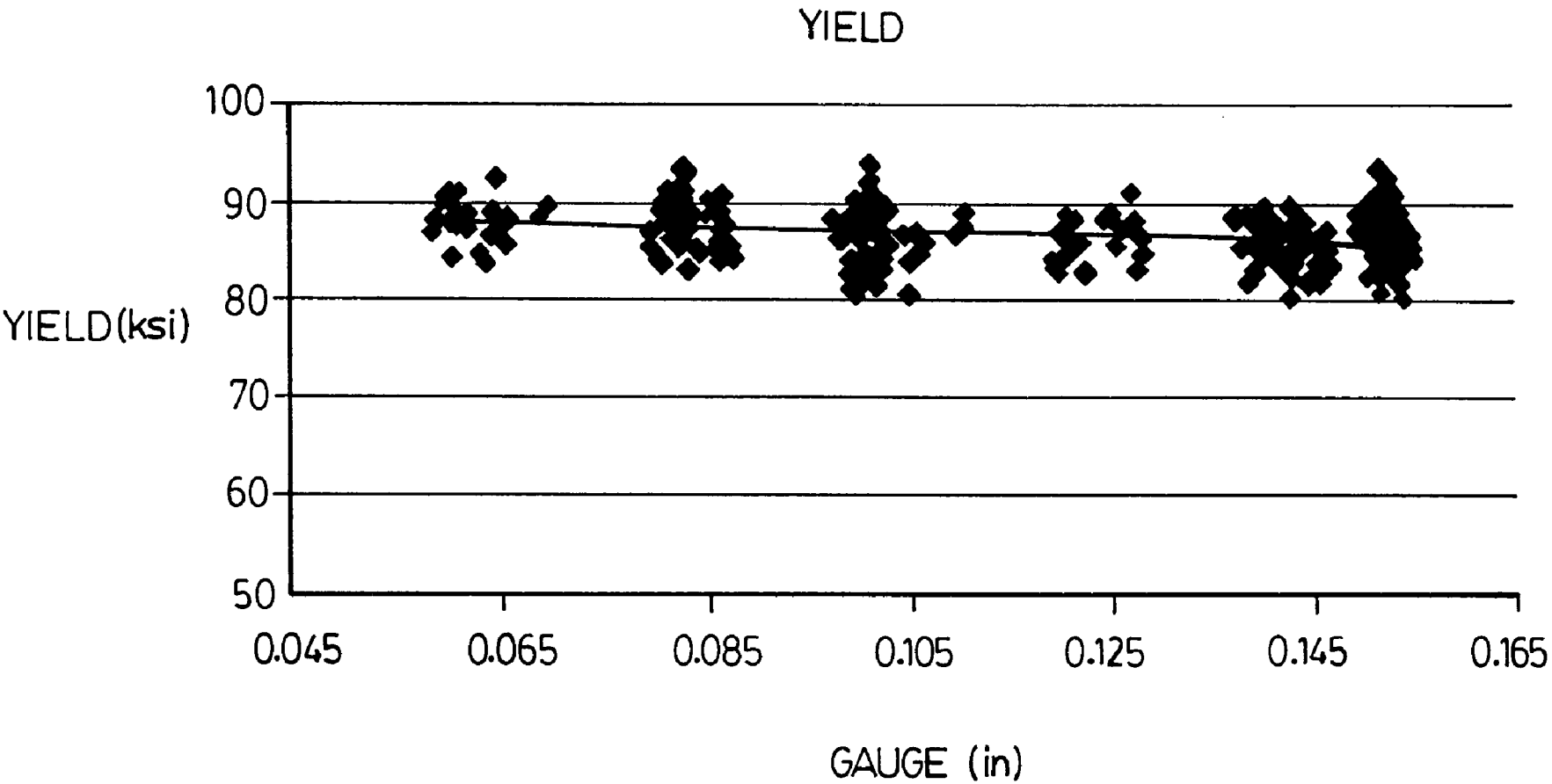
FIG. 2 is a graph of yield strength against thickness of HSLA steel produced according to the present invention.

In the process of the present invention, the added recrystallization step provides the rough-reduced steel product with increased grain refinement over the as-cast product. It is known that grain refinement is a major strengthening mechanism and therefore the flat rolled steel product 50 has high strength, typically exceeding 70 ksi and preferably having a strength of at least about 550 MPa (80 ksi). In this regard, FIG. 2 graphically illustrates a plot of yield strength against thickness (gauge), which shows that flat rolled steel product produced according to the invention has high yield strength, in excess of 80 ksi, typically 80 to 90 ksi, regardless of the gauge to which it is reduced. However, since there is little or no precipitation of the microalloy until after the material passes through the strip mill, the material being rolled is relatively "soft" as compared to known processes. Therefore, less power is required to roll the material in the strip mill 32 and there is a corresponding improvement in dimensional control. Since power required by the strip mill is a function of volume and cross-sectional area of the material being rolled, the reduced power demands of the process according to the invention also permits the production of material having greater width dimensions than previously possible.

Figure 3:
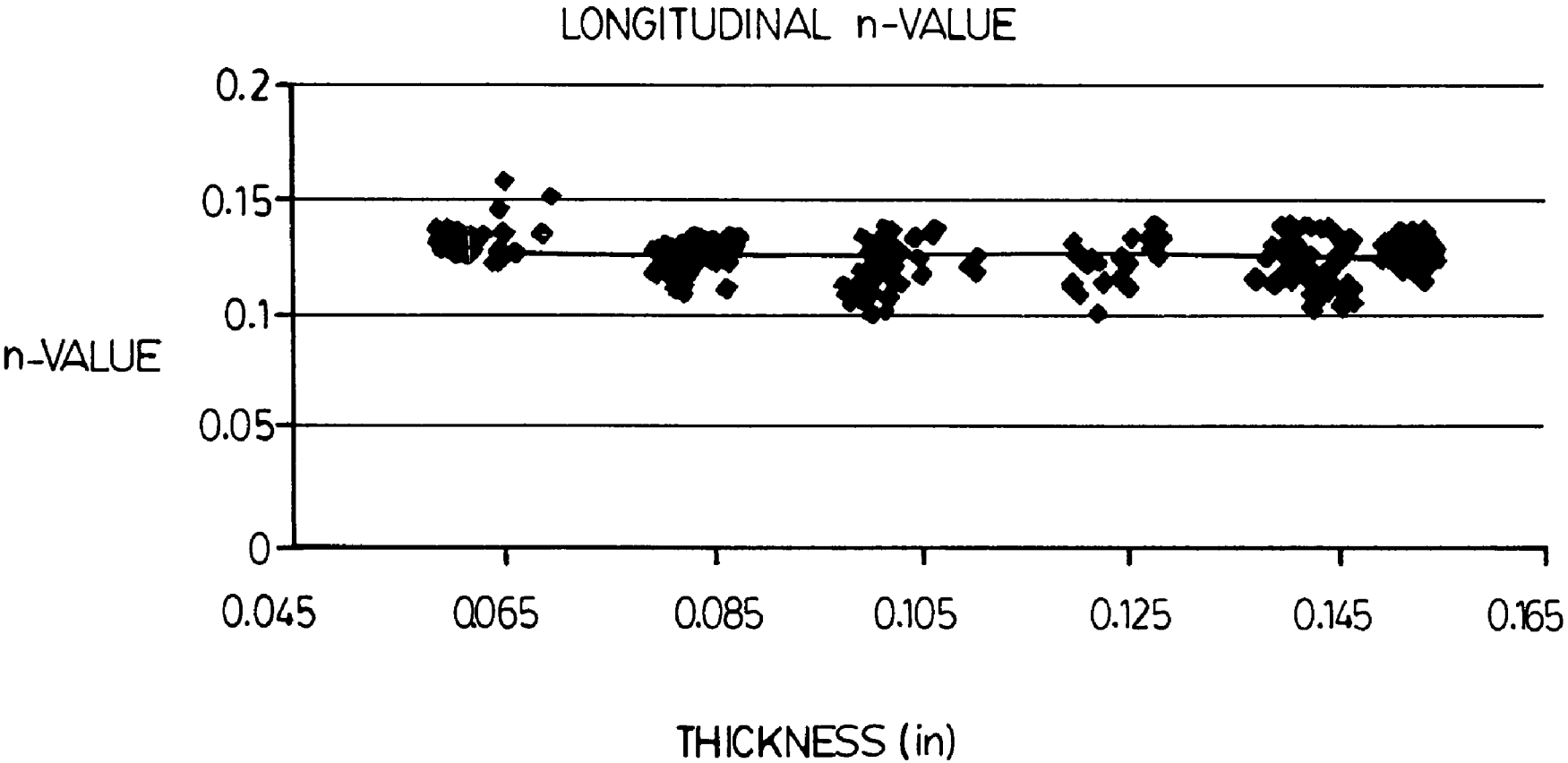
FIG. 3 is a graph of n-value (formability) against thickness of HSLA steel produced according to the present invention.

The inventors have also found that the flat rolled steel product 50 according to the invention possesses greater formability than materials produced by prior art thin-slab and medium-slab casting processes. As mentioned above, formability is important in the production of shaped parts. Formability is represented by an "n-value" determined in accordance with ASTM A646 (00), Tensile Strain Hardening Exponents (n-value) of Metallic Sheet Material, a longitudinal tensile test. The inventors have surprisingly found that the formability of the flat rolled steel product 50 is essentially independent of the thickness to which the product is rolled in the strip mill 32. This is shown graphically in FIG. 3, which comprises a plot of the n-value against thickness of the product. The n-values achieved according to the method of the invention are preferably above about 0.1, more preferably in the range from about 0.1 to about 0.16. Even more preferably, the n-values are about 0.13. Thus, the formability of the steel is preserved independently of the level of thickness reduction in the strip mill, permitting the production of formable high strength steel in a wide range of gauges.

In the process according to the invention, the yield strength of the flat-rolled steel product 50 is increased from the 80 ksi range to about 100 ksi (690 MPa) or higher. This process involves the preparation of a high strength, formable flat rolled product 50 by the process steps described above, and then further reducing the thickness (gauge) of the flat rolled product 50 by about an additional 2 to 20%, more preferably by about an additional 5 to 20%, to produce a cold-rolled product 60.

Preferably, the further reduction in gauge is obtained by cold rolling the flat rolled product 50 in a cold rolling mill 54, preferably starting from ambient temperature. As shown in FIG. 1, the flat rolled product 50, after cooling to a temperature which is at or near ambient temperature, is unwound from coil 52 and fed to the cold rolling mill 54. The cold rolling mill comprises one or more rolling stands 56, each comprising a pair of rollers, and may preferably comprise a reversing cold mill. In FIG. 1, only a single rolling stand 56 is shown.

The number of passes and/or the number of rolling stands is selected to achieve the desired thickness and physical properties. In a preferred example where the desired final thickness of the cold-rolled product 60 is from about 1.0 to about 4 mm, the thickness reduction can typically be obtained in one or two passes. Instead of a cold rolling mill 54, it may be preferred to cold roll the material in a temper mill to achieve the desired gauge reduction using multiple passes, if necessary. In some embodiments of the invention, the desired final thickness of the cold-rolled product 60 may be in the range from about 1.0 to about 1.5 mm.

The inventors have found that the additional reduction step may produce a corresponding decrease in formability of the cold rolled product 60 as compared to the flat rolled product 50. However, the inventors have found that the formability of the cold rolled product is still within acceptable limits for its intended end uses.

Figure 4:
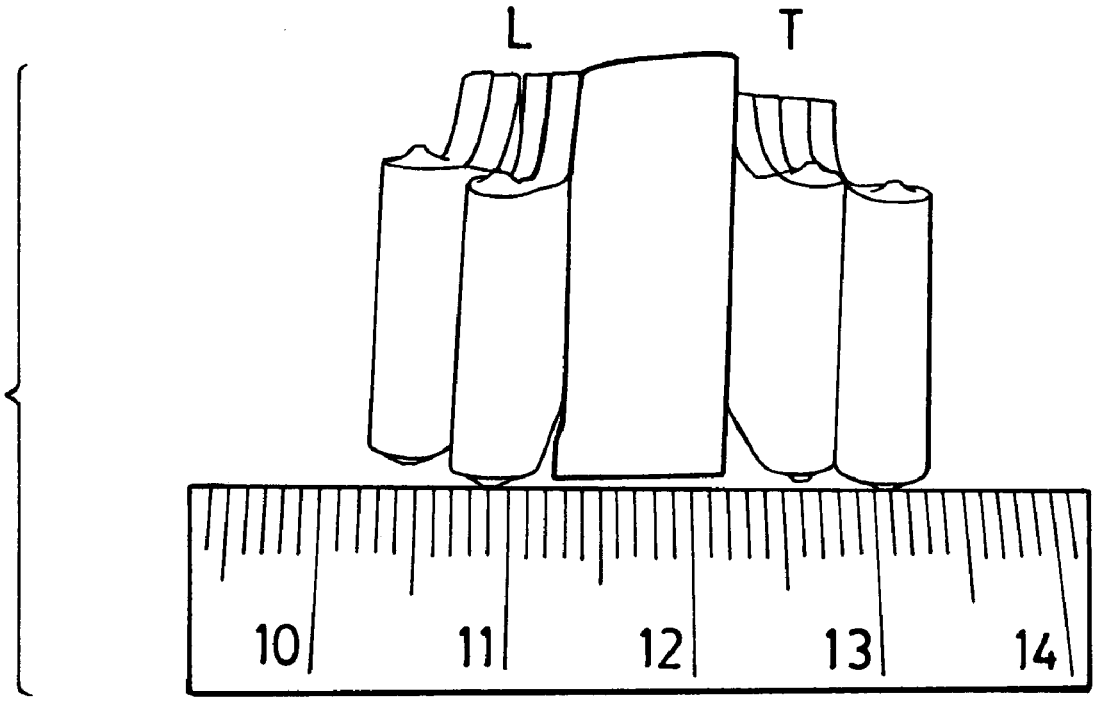
FIG. 4 is a photograph of a first steel sample according to the invention having undergone longitudinal (L) and transverse (T) bending tests.

Testing of steel samples according to the present invention has shown that cold rolling of the flat rolled steel product 50 simultaneously brings about an increase in strength and a decrease in formability. For example, where the strength of a flat rolled steel product 50 is increased from the range of about 80 to 90 ksi to above 100 ksi by the process of the invention, the formability of the cold rolled product 60 is such that it can withstand a longitudinal or transverse 180° bend of less than 0.5 T radius with no cracking in the longitudinal or transverse directions, where T is the thickness of the material. Shown in FIG. 4 is a sample of 100 ksi cold rolled product 60 which has been bent 180° longitudinally (L) and transversely (T) about a 0.3 T radius without cracking in either direction.

Figure 5:
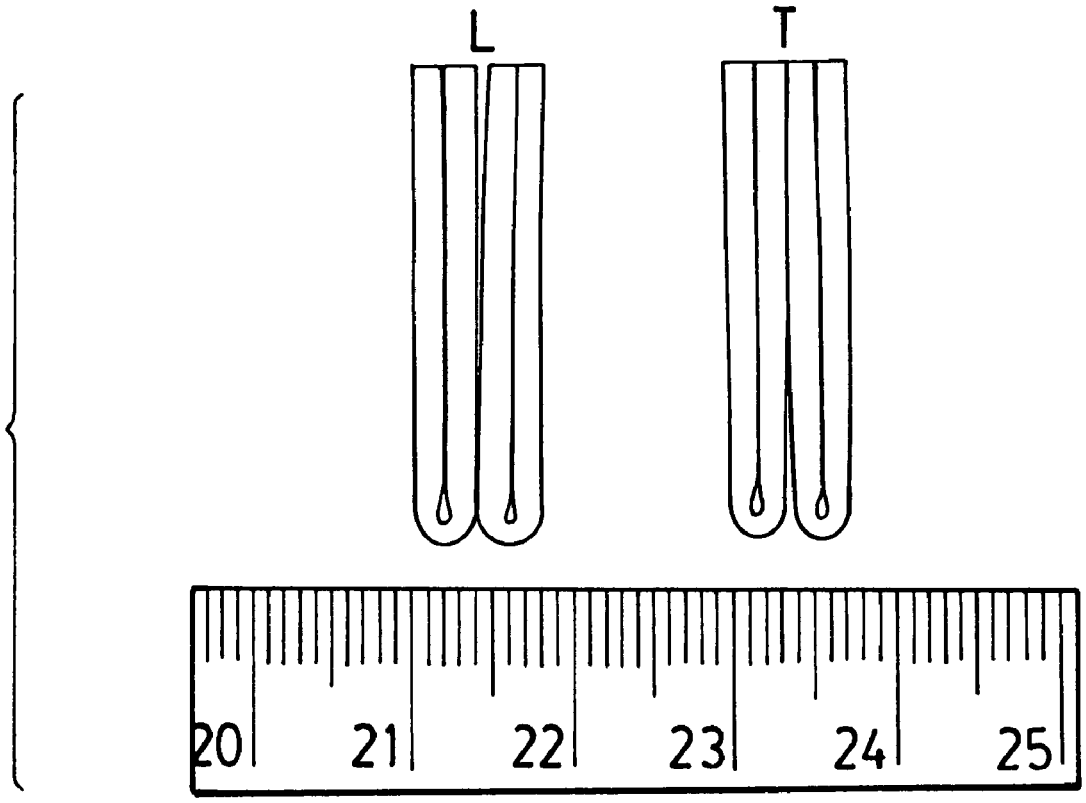
FIG. 5 is a photograph of a second steel sample according to the invention having undergone longitudinal (L) and transverse (T) bending tests.

By further increasing the amount of cold reduction, the strength of the flat rolled steel product 50 can be increased from the range of about 80 ksi to 90 ksi to at least about 110 ksi, with a further decrease in formability. The inventors have found that 110 ksi cold rolled product 60 is able to withstand a longitudinal or transverse 180° bend of less than 1 T radius with no cracking in the longitudinal or transverse directions. FIG. 5 illustrates a sample of 110 ksi cold rolled product 60 which has been bent 180° longitudinally (L) and transversely (T) about a 1 T radius without cracking in either direction.

Preferably, oxide scale on the surface of the flat rolled product 50 is removed prior to the cold rolling step. The oxide scale, which may comprise iron oxides $Fe_2O_3$, $Fe_3O_4$ and FeO, is preferably removed by "pickling" the cold-rolled product, i.e. treating it with hot acid, preferably HCl, to dissolve and remove the oxide scale. In the preferred embodiment shown in FIG. 1, the flat rolled product 50 is passed through at least one pickling tank 62 containing hot hydrochloric acid prior to entering the cold rolling mill 54.

In the prior art, steel having a strength level of 100 ksi is produced by heavy alloying of the hot rolled product, by recovery annealing or by heat treating to achieve microstructures other than ferrite/pearlite. Annealing is done to relieve the work hardening of the product through cold reduction and somewhat improves the formability of the material. In the process of the present invention, the yield strength is significantly increased without an inhibiting reduction in formability, and therefore annealing is not required.

Once it emerges from the cold rolling mill 54, the high strength cold rolled product 60 is preferably wound onto coils 64 for shipment to the end user.

As stated throughout this application, the temperature of the steel product as it passes through the rougher and the strip mill is greater than the recrystallization stop temperature and above a temperature at which significant precipitation of the microalloy will occur. It will be appreciated that these temperatures are not necessarily greater than the precipitation start temperature of the microalloy which, for vanadium nitride microalloys, is typically in the range from about 950 to 1110° C. In fact, it has been found that there will be some microalloy precipitation at even higher temperatures. It will be appreciated that microalloy precipitation is a solid state reaction which is controlled by diffusion, and is therefore time-dependent. Therefore, even at temperatures below the precipitation start temperature, there will be little precipitation of microalloy until after the steel product exits the strip mill. In other words, the driving force for precipitation is small as the steel passes through the rougher and the strip mill at relatively high temperatures, and becomes greater as the steel is cooled to coiling temperatures, such that the precipitation is driven to completion.

The term "recrystallization stop temperature" as used herein is the temperature above which the austenite grains in the steel product reform, i.e. recrystallize, into lower energy configurations. The recrystallization stop temperature is dependent on the composition of the steel, and for preferred steel products of the type described and claimed in this application having vanadium nitride microalloys, the recrystallization stop temperature is typically about 1020° C.

Although the invention has been described in connection with certain preferred embodiments, it is not restricted thereto. Rather, the invention includes within its scope all embodiments which fall within the scope of the following claims.

What is claimed is:

1. A process for producing a steel product comprised of high strength, low alloy steel containing a hardness-promoting vanadium nitride microalloy and having a yield strength of at least about 100 ksi, the process comprising:

(a) casting molten steel to form a solid, as-cast product having a thickness, the as-cast product comprising austenite;

(b) transferring the as-cast product to a first rolling apparatus, wherein a temperature of the as-cast product as it enters the first rolling apparatus is greater than a recrystallization stop temperature of the austenite and above about 1020° C.;

(c) conducting a first reduction step in the first rolling apparatus to reduce the thickness of the as-cast product by a first amount, thereby producing a first thickness-reduced product, wherein a temperature of the as-cast product entering the first rolling apparatus and a temperature of the first thickness-reduced product exiting the first rolling apparatus are above the recrystallization stop temperature and above about 1020° C.;

(d) heating the first thickness-reduced product with a heating apparatus so as to maintain the first thickness-reduced product at a temperature above the recrystallization stop temperature and above about 1020° C., and holding the first thickness-reduced product at said temperature, while heating it with said heating apparatus, for a time sufficient to permit substantially complete recrystallization of the austenite and thereby reduce a grain size of the austenite;

(e) transferring the first thickness-reduced product to a second rolling apparatus comprised of a plurality of rolling stands;

(f) conducting a second reduction step in the second rolling apparatus to reduce the thickness of the first thickness-reduced product by a second amount, thereby producing a second thickness-reduced product, wherein a temperature of the first thickness-reduced product entering the second rolling apparatus is above the recrystallization stop temperature and above about 1020° C., and a temperature of the second thickness-reduced product exiting the second rolling apparatus is above a phase transformation temperature at which austenite is transformed to ferrite;

(g) cooling the second thickness-reduced product to below the phase transformation temperature, thereby producing a cooled product; and (h) conducting a third reduction step in a third rolling apparatus to reduce the thickness of the cooled product by a third amount, thereby producing the steel product having a yield strength of at least about 100 ksi.

2. The process of claim 1 wherein the as-cast product produced by casting said molten steel is hot charged into a furnace without first cooling it to ambient temperature, such that the temperature of the as-cast product is maintained above the recrystallization stop temperature and above about 1020° C. between steps (a) and (b) and throughout steps (a) and (b).

3. The process of claim 2, wherein the temperature of the as-cast product is maintained in the range of above about 1020° C. to about 1200° C. throughout steps (a) and (b) and between steps (a) and (b).

4. The process of claim 1, wherein the thickness of the as-cast product is from about 30 mm to about 200 mm.

5. The process of claim 1, wherein the thickness of the as-cast product is from about 50 mm to about 80 mm.

6. The process of claim 1, wherein the first amount of thickness reduction produced in the first rolling apparatus is from about 40 percent to about 60 percent of the thickness of the as-cast product.

7. The process of claim 1, wherein the second amount of thickness reduction is greater than the first amount of thickness reduction, wherein the second amount of thickness reduction is measured as a fraction of the thickness of the first thickness-reduced product and the first thickness reduction is measured as a fraction of the thickness of the as-cast product.

8. The process of claim 1, wherein the temperature of the as-cast product as it enters the first rolling apparatus and the temperature of the first thickness-reduced product exiting the first rolling apparatus is in the range of above about 1020° C. to about 1200° C.

9. The process of claim 1, wherein the second amount of thickness reduction produced in the second rolling apparatus is from about 80 to about 98 percent of the thickness of the first thickness-reduced product.

10. The process of claim 1, wherein the thickness of the second thickness-reduced product is from about 1 mm to about 6 mm.

11. The process of claim 1, wherein the thickness of the second thickness-reduced product is from about 1 mm to about 2 mm.

12. The process of claim 1, wherein the temperature at which the first thickness-reduced product enters the second rolling apparatus is in the range of above about 1020 C. to about 1200° C.

13. The process of claim 1, wherein the second thickness-reduced product exits the second rolling apparatus at a temperature In the range from about 820 to about 950° C.

14. The process of claim 1, wherein the second thickness-reduced product is cooled to a temperature in the range from about 550 to about 700° C. to produce the cooled product.

15. The process of claim 1, wherein the third amount of thickness reduction is less than the second amount of thickness reduction.

16. The process of claim 1, wherein the third amount of thickness reduction is from about 2 to about 20 percent of the thickness of the second thickness-reduced product.

17. The process of claim 1, wherein the cooled product is at ambient temperature when it enters the third rolling apparatus.

18. The process of claim 1, wherein the cooled product has a yield strength of at least about 70 ksi.

19. The process of claim 1, wherein the cooled product has a yield strength of at least about 80 ksi (550 MPa).

20. The process of claim 1, wherein the cooled product has a formability, as measured by n-value, within the range from about 0.1 to about 0.16.

21. The process of claim 1, wherein the steel product has a yield strength of at least about 100 ksi and a formability such that it can withstand a longitudinal or transverse 180° bend of less than about 0.5 times its thickness without longitudinal or transverse cracking.

22. The process of claim 1, wherein the steel product has a yield strength of at least about 110 ksi and a formability such that it can withstand a longitudinal or transverse 180° bend of less than about 1 times its thickness without longitudinal or transverse cracking.

23. The process of claim 1, wherein the first rolling apparatus comprises a rougher.

24. The process of claim 1, wherein the second rolling apparatus comprises a hot rolling strip mill comprising from four to six of said rolling stands.

25. The process of claim 1, wherein said heating apparatus of step (d) comprises a heated run-out table or a second furnace and is located between the first rolling apparatus and the second rolling apparatus.

26. The process of claim 1, wherein the temperature at which the first thickness-reduced product is held in step (d) is from above about 1020° C. to about 1150° C.

27. The process of claim 1, wherein the thickness of the steel product is from about 1.0 mm to about 4 mm.

28. The process of claim 1 further comprising pickling the cooled product to remove oxides prior to the third reduction step.

29. The process of claim 1, wherein the steel product contains nitrogen in a sub-stoichiometric ratio relative to vanadium.

30. The process of claim 29, wherein the steel product contains nitrogen in an amount of about 0.020 wt % and vanadium in an amount from about 0.10 to about 0.12 wt %.

31. The process of claim 29, wherein the product contains one or more elements selected from the group consisting of carbon, manganese, silicon, molybdenum, niobium and aluminum.

32. The process of claim 1, wherein said time sufficient to permit substantially complete recrystallization of the austenite is from about 10 to about 30 seconds.

33. The process of claim 32, wherein said time sufficient to permit substantially complete recrystallization of the austenite is from about 15 to about 25 seconds.

34. The process of claim 1, wherein said substantially complete recrystallization of the austenite is such that at least about 90 percent of the austenite grains are reduced to a size from about 100 to about 400 microns by said recrystallization.

* * * * *